US009217299B2

(12) United States Patent
Moriarty et al.

(10) Patent No.: US 9,217,299 B2
(45) Date of Patent: Dec. 22, 2015

(54) DRILLING BOTTOM HOLE ASSEMBLY HAVING WIRELESS POWER AND DATA CONNECTION

(71) Applicant: Schlumberger Technology Corporation, Sugar Land, TX (US)

(72) Inventors: Keith A. Moriarty, Houston, TX (US); Raphael Gadot, Houston, TX (US); Brian Oliver Clark, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 406 days.

(21) Appl. No.: 13/797,584

(22) Filed: Mar. 12, 2013

(65) Prior Publication Data

US 2014/0083768 A1 Mar. 27, 2014

Related U.S. Application Data

(60) Provisional application No. 61/704,620, filed on Sep. 24, 2012, provisional application No. 61/704,805, filed on Sep. 24, 2012, provisional application No. 61/704,758, filed on Sep. 24, 2012.

(51) Int. Cl.

| | |
|---|---|
| ***E21B 17/04*** | (2006.01) |
| ***E21B 17/02*** | (2006.01) |
| ***E21B 7/04*** | (2006.01) |
| ***E21B 47/12*** | (2012.01) |
| ***E21B 4/02*** | (2006.01) |

(Continued)

(52) U.S. Cl.

CPC ..... *E21B 17/028* (2013.01); *E21B 4/02* (2013.01); *E21B 7/04* (2013.01); *E21B 7/068* (2013.01); *E21B 47/122* (2013.01); *E21B 41/0085* (2013.01)

(58) Field of Classification Search

CPC ..... E21B 4/02; E21B 7/04; E21B 7/068; E21B 17/028; E21B 41/0085; E21B 47/01; E21B 47/02

See application file for complete search history.

(56) References Cited

U.S. PATENT DOCUMENTS

| | | | |
|---|---|---|---|
| 5,394,951 | A | 3/1995 | Pringle et al. |
| 6,047,784 | A | 4/2000 | Dorel |

(Continued)

FOREIGN PATENT DOCUMENTS

| | | | |
|---|---|---|---|
| RU | 2213370 | C2 | 9/2003 |

OTHER PUBLICATIONS

International Search Report and the Written Opinion for International Application No. PCT/US2013/061150 dated Jan. 16, 2014.

*Primary Examiner* — Brad Harcourt
(74) *Attorney, Agent, or Firm* — John Vereb

(57) ABSTRACT

A bottom hole assembly (BHA) configured for use in a drill string of a wellsite drilling system. The BHA includes a measuring-while-drilling (MWD) module, a wireless power and data connection, and a rotary steerable system (RSS). The MWD module is configured for coupling to a drill string, and includes a power generation component and a direction and inclination (D&I) survey package. The wireless power and data connection is disposed above a drilling motor in the drill string and for providing power and data connectivity between the MWD module and the drilling motor. The RSS is coupled to the drilling motor for receiving power from and communicating with the MWD module via the wireless power and data connection and the drilling motor.

12 Claims, 18 Drawing Sheets

(51) Int. Cl.
*E21B 7/06* (2006.01)
*E21B 41/00* (2006.01)

(56) References Cited

U.S. PATENT DOCUMENTS

| | | | | |
|---|---|---|---|---|
| 6,392,561 | B1 | 5/2002 | Davies et al. | |
| 6,419,014 | B1 | 7/2002 | Meek et al. | |
| 6,427,783 | B2 | 8/2002 | Krueger et al. | |
| 7,190,084 | B2 | 3/2007 | Hall et al. | |
| 7,552,761 | B2 | 6/2009 | Moriarty | |
| 7,591,304 | B2 | 9/2009 | Juhasz et al. | |
| 7,666,668 | B2 | 2/2010 | Bujard et al. | |
| 8,146,679 | B2 | 4/2012 | Downton | |
| 8,408,333 | B2 | 4/2013 | Pai et al. | |
| 2001/0042643 | A1* | 11/2001 | Krueger et al. | 175/73 |
| 2005/0252688 | A1 | 11/2005 | Head et al. | |
| 2006/0054354 | A1 | 3/2006 | Orban | |
| 2006/0086536 | A1 | 4/2006 | Boyle et al. | |
| 2006/0260806 | A1 | 11/2006 | Moriarty | |
| 2007/0159351 | A1* | 7/2007 | Madhavan et al. | 340/855.1 |
| 2007/0261887 | A1 | 11/2007 | Pai et al. | |
| 2008/0277163 | A1 | 11/2008 | Moriarty | |
| 2010/0018770 | A1 | 1/2010 | Moriarty et al. | |
| 2012/0111561 | A1 | 5/2012 | Frey et al. | |

* cited by examiner

DRILLING BOTTOM HOLE ASSEMBLY HAVING WIRELESS POWER AND DATA CONNECTION

CROSS-REFERENCE TO RELATED APPLICATIONS

This application claims the benefit of and priority to U.S. Provisional Patent Application Ser. No. 61/704,620, entitled "Drilling Bore Hole Assembly With A Wireless Power and Data Connection," and filed on Sep. 24, 2012, U.S. Provisional Patent Application Ser. No. 61/704,805, entitled "System And Method for Wireless Power And Data Transmission In A Mud Motor," and filed on Sep. 24, 2012, and U.S. Provisional Patent Application Ser. No. 61/704,758, entitled "Positive Displacement Motor Rotary Steerable System And Apparatus," and filed on Sep. 24, 2012, the disclosures of which are hereby incorporated by reference in their entireties.

DESCRIPTION OF THE RELATED ART

In drilling operations, such as directional applications, bottom hole assemblies (BHAs) have become increasingly sophisticated with various high performance elements. For example, BHAs may include rotary steerable systems (RSS), formation evaluation (FE) measurements, direction and inclination (D&I) measurements with high data rate mud pulse telemetry, and power generation systems from measuring-while-drilling (MWD) and logging-while-drilling (LWD) tools.

Drilling motors are increasingly used in conjunction with RSS and MWD/LWD BHAs, which creates various challenges for distributing power and data within the BHA components while maintaining optimal placement of the MWD system and the mud pulse telemetry within the BHA, as well as other measurements (e.g., FE, D&I, etc.) and functionalities in the BHA.

Furthermore, due to the high cost of deployment of the drilling operation, it is becoming increasingly desirable to optimize drilling performance. A methodology to optimize drilling performance is to measure downhole drilling conditions, and provide this information to the driller for adjusting various parameters, such as, weight on bit, drill pipe revolutions per minute, accelerations, stick and slip conditions, etc. Typically, this information is acquired in different locations of the BHA and recorded for surface analysis once the BHA is pulled out of the hole. A standard configuration for drilling optimization or directional drilling is to place a drilling mud motor between the drilling bit and the MWD. In this case, however, the transmission of power and data communications to the drill bit is technically challenging and costly because it has to cross a rotational joint in the mud motor.

Accordingly, there is a need in the art for improved BHA configurations for enabling power and data connectivity between components of the BHA.

SUMMARY OF THE DISCLOSURE

Various embodiments of system and methods are disclosed for providing wireless power and data communications in a bottom hole assembly. One such method includes coupling a measuring-while-drilling (MWD) module to a drill string. A wireless power and data connection is located above a drilling motor in the drill string for providing power and data between the MWD module and the drilling motor. A rotary steerable system (RSS) is coupled to the drilling motor for receiving power from and communicating with the MWD module via the wireless power and data connection.

Another embodiment is a bottom hole assembly (BHA) configured for use in a drill string of a wellsite drilling system. The BHA includes a measuring-while-drilling (MWD) module, a wireless power and data connection, and a rotary steerable system (RSS). The MWD module is configured for coupling to a drill string, and includes a power generation component and a direction and inclination (D&I) survey package. The wireless power and data connection is disposed above a drilling motor in the drill string for providing power and data connectivity between the MWD module and a drilling motor. The RSS is coupled to the drilling motor for receiving power from and communicating with the MWD module via the wireless power and data connection and the drilling motor.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the Figures, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION

Figure 1A:
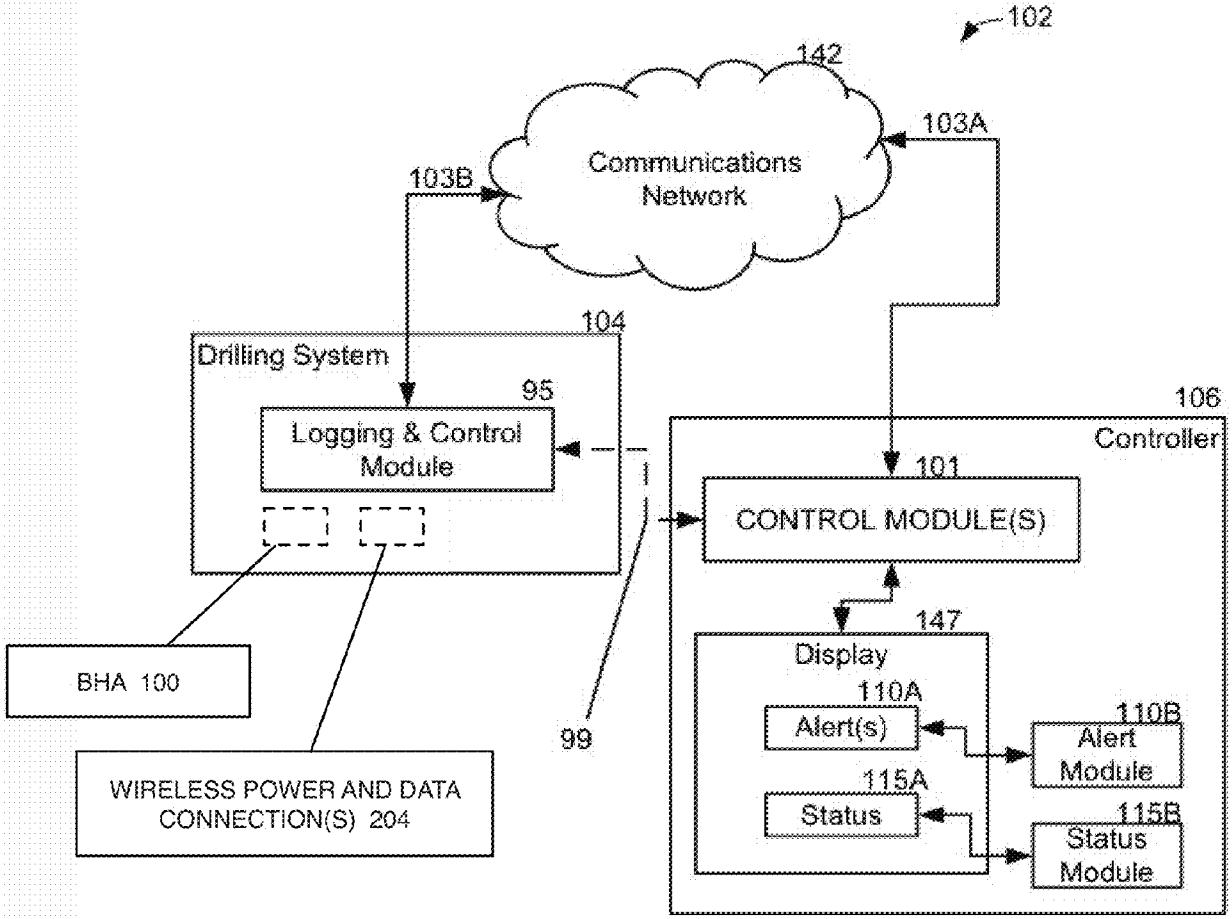
FIG. 1A is a diagram of a system for enabling wireless power and data transfer between components in a drilling operation.

Various embodiments of systems and methods are disclosed for providing power and/or data communications in a drilling assembly. Referring initially to FIG. 1A, this figure is a diagram of a system 102 for enabling wireless power and data transfer between components in a drilling operation. The system 102 includes a controller module 101 that is part of a controller 106. The system 102 also includes a drilling system 104, which has a logging and control module 95, a bottom hole assembly ("BHA") 100, and wireless power and data connections 204. The controller 106 further includes a display 147 for conveying alerts 110A and status information 115A that are produced by an alerts module 110B and a status module 115B. The controller 102 may communicate with the drilling system 104 via a communications network 142.

The controller 106 and the drilling system 104 may be coupled to the communications network 142 via communication links 103. Many of the system elements illustrated in FIG. 1A are coupled via communications links 103 to the communications network 142.

The links 103 illustrated in FIG. 1A may include wired or wireless couplings or links. Wireless links include, but are not limited to, radio-frequency ("RF") links, infrared links, acoustic links, and other wireless mediums. The communications network 142 may include a wide area network ("WAN"), a local area network ("LAN"), the Internet, a Public Switched Telephony Network ("PSTN"), a paging network, or a combination thereof. The communications network 142 may be established by broadcast RF transceiver towers (not illustrated). However, one of ordinary skill in the art recognizes that other types of communication devices besides broadcast RF transceiver towers are included within the scope of this disclosure for establishing the communications network 142.

The drilling system 104 and controller 106 of the system 102 may have RF antennas so that each element may establish wireless communication links 103 with the communications network 142 via RF transceiver towers (not illustrated). Alternatively, the controller 106 and drilling system 104 of the system 102 may be directly coupled to the communications network 142 with a wired connection. The controller 106 in some instances may communicate directly with the drilling system 104 as indicated by dashed line 99 or the controller 106 may communicate indirectly with the drilling system 104 using the communications network 142.

The controller module 101 may include software or hardware (or both). The controller module 101 may generate the alerts 110A that may be rendered on the display 147. The alerts 110A may be visual in nature but they may also include audible alerts as understood by one of ordinary skill in the art.

The display 147 may include a computer screen or other visual device. The display 147 may be part of a separate stand-alone portable computing device that is coupled to the logging and control module 95 of the drilling system 104. The logging and control module 95 may include hardware or software (or both) for direct control of a bottom hole assembly 100 as understood by one of ordinary skill in the art.

Figure 1B:
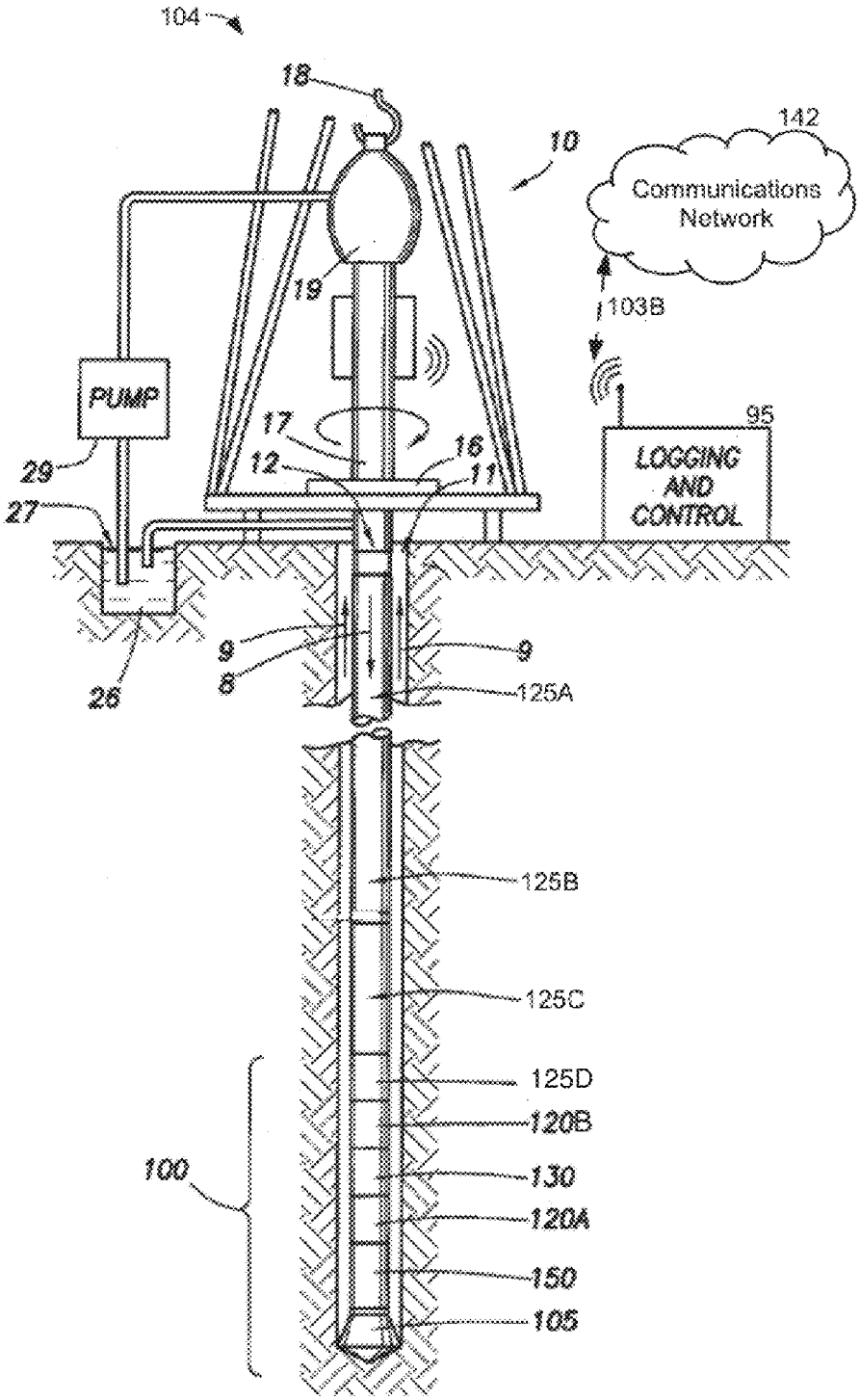
FIG. 1B is a diagram of a wellsite drilling system that forms part of the system illustrated in FIG. 1A.

FIG. 1B illustrates a wellsite drilling system 104 that forms part of the system 102 illustrated in FIG. 1A. The wellsite can be onshore or offshore. In this system 104, a borehole 11 is formed in subsurface formations by rotary drilling in a manner that is known to one of ordinary skill in the art. Embodiments of the system 104 can also use directional drilling, as will be described hereinafter. The drilling system 104 includes the logging and control module 95 as discussed above in connection with FIG. 1A.

A drill string 12 is suspended within the borehole 11 and has a bottom hole assembly ("BHA") 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string 12 relative to the hook 18. As is known to one of ordinary skill in the art, a top drive system could alternatively be used instead of the kelly 17 and rotary table 16 to rotate the drill string 12 from the surface. The drill string 12 may be assembled from a plurality of segments 125 of pipe and/or collars threadedly joined end to end.

In the embodiment of FIG. 1B, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this system as understood by one of ordinary skill in the art, the drilling fluid 26 lubricates the drill bit 105 and carries formation cuttings up to the surface as it is returned to the pit 27 for cleaning and recirculation.

The bottom hole assembly 100 of the illustrated embodiment may include a logging-while-drilling (LWD) module 120, a measuring-while-drilling (MWD) module 130, a rotary-steerable system and motor 150, and drill bit 105.

The LWD module 120 is housed in a special type of drill collar, as is known to one of ordinary skill in the art, and can contain one or a plurality of known types of logging tools. It will also be understood that more than one LWD 120 and/or MWD module 130 can be employed, e.g. as represented at 120A. (References, throughout, to a module at the position of 120A can alternatively mean a module at the position of 120B as well.) The LWD module 120 includes capabilities for measuring, processing, and storing information, as well as for communicating with the surface equipment. In the present embodiment, the LWD module 120 includes a directional resistivity measuring device.

The MWD module 130 is also housed in a special type of drill collar, as is known to one of ordinary skill in the art, and can contain one or more devices for measuring characteristics of the drill string 12 and drill bit 105. The MWD module 130 may further includes an apparatus (not shown) for generating electrical power to the downhole system 100.

This apparatus may typically include a mud turbine generator powered by the flow of the drilling fluid 26, it being understood by one of ordinary skill in the art that other power and/or battery systems may be employed. In the embodiment, the MWD module 130 includes one or more of the following types of measuring devices: a weight-on-bit measuring device, a torque measuring device, a vibration measuring device, a shock measuring device, a stick slip measuring device, a direction measuring device, and an inclination measuring device.

The foregoing examples of wireline and drill string conveyance of a well logging instrument are not to be construed as a limitation on the types of conveyance that may be used for the well logging instrument. Any other conveyance known to one of ordinary skill in the art may be used, including without limitation, slickline (solid wire cable), coiled tubing, well tractor and production tubing.

FIGS. 2-14 illustrate various embodiments for implementing the wireless power and data connection 204. As described below in more detail, the wireless power and data connection 204 generally includes a wireless, tuned-inductive coupler mechanism for passing both power and data communications to downhole components in a bottom hole assembly. It should be appreciated that the wireless power and data connection 204 may be incorporated in various types and configurations of drilling assemblies.

Figure 2:
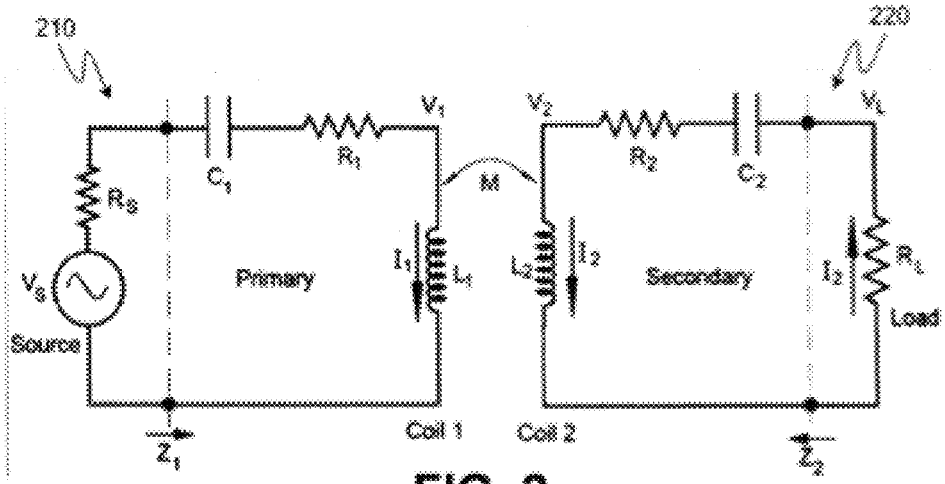
FIG. 2 is a schematic drawing depicting a primary or transmitting circuit and a secondary or receiving circuit.

FIG. 2 is a schematic drawing depicting a primary or transmitting circuit 210 and a secondary or receiving circuit 220. In this description, the time dependence is assumed to be exp(jωt) where ω=2πf and f is the frequency in Hertz. Returning to the FIG. 2 illustration, the transmitting coil is represented as an inductance $L_1$ and the receiving coil as $L_2$. In the primary circuit 210, a voltage generator with constant output voltage $V_S$ and source resistance $R_S$ drives a current $I_1$ through a tuning capacitor $C_1$ and primary coil having self-inductance $L_1$ and series resistance $R_1$. The secondary circuit 220 has self-inductance $L_2$ and series resistance $R_2$. The resistances, $R_1$ and $R_2$, may be due to the coils' wires, to losses in the coils magnetic cores (if present), and to conductive materials or mediums surrounding the coils. The Emf (electromotive force) generated in the receiving coil is $V_2$, which drives current $I_2$ through the load resistance $R_L$ and tuning capacitor $C_2$. The mutual inductance between the two coils is M, and the coupling coefficient k is defined as:

$$k=M/\sqrt{L_1L_2} \tag{1}$$

While a conventional inductive coupler has k≈1, weakly coupled coils may have a value for k less than 1 such as, for example, less than or equal to about 0.9. To compensate for weak coupling, the primary and secondary coils in the various embodiments are resonated at the same frequency. The resonance frequency is calculated as:

$$\omega_0 = \frac{1}{\sqrt{L_1C_1}} = \frac{1}{\sqrt{L_2C_2}} \tag{2}$$

At resonance, the reactance due to $L_1$ is cancelled by the reactance due to $C_1$. Similarly, the reactance due to $L_2$ is cancelled by the reactance due to $C_2$. Efficient power transfer may occur at the resonance frequency, $f_0=\omega_0/2\pi$. In addition, both coils may be associated with high quality factors, defined as:

$$Q_1 = \frac{\omega L_1}{R_1} \text{ and } Q_2 = \frac{\omega L_2}{R_2}. \tag{3}$$

The quality factors, Q, may be greater than or equal to about 10 and in some embodiments greater than or equal to about 100. As is understood by one of ordinary skill in the art, the quality factor of a coil is a dimensionless parameter that characterizes the coil's bandwidth relative to its center frequency and, as such, a higher Q value may thus indicate a lower rate of energy loss as compared to coils with lower Q values.

If the coils are loosely coupled such that k<1, then efficient power transfer may be achieved provided the figure of merit, U, is larger than one such as, for example, greater than or equal to about 3:

$$U=k\sqrt{Q_1Q_2}>>1. \tag{4}$$

The primary and secondary circuits are coupled together via:

$$V_1=j\omega L_1I_1+j\omega MI_2 \text{ and } V_2=j\omega L_2I_2+j\omega MI_1, \tag{5}$$

where $V_1$ is the voltage across the transmitting coil. Note that the current is defined as clockwise in the primary circuit and counterclockwise in the secondary circuit. The power delivered to the load resistance is:

$$P_L = \frac{1}{2}R_L|I_2|^2, \tag{6}$$

while the maximum theoretical power output from the fixed voltage source $V_S$ into a load is:

$$P_{MAX} = \frac{|V_S|^2}{8R_S}. \tag{7}$$

The power efficiency is defined as the power delivered to the load divided by the maximum possible power output from the source, $$\eta \equiv \frac{P_L}{P_{MAX}}. \tag{8}$$

In order to optimize the power efficiency, η, the source resistance may be matched to the impedance of the rest of the circuitry. Referring to FIG. 2, $Z_1$ is the impedance looking from the source toward the load and is given by:

$$Z_1 = R_1 - j/(\omega C_1) + j\omega L_1 + \frac{\omega^2 M^2}{R_2 + R_L + j\omega L_2 - j/(\omega C_2)} \tag{9}$$

When $\omega=\omega_0$, $Z_1$ is purely resistive and may equal $R_S$ for maximum efficiency.

$$Z_1 = R_1 + \frac{\omega^2 M^2}{R_2 + R_L} \equiv R_S. \tag{10}$$

Similarly, the impedance seen by the load looking back toward the source is $$Z_2 = R_2 - j/(\omega C_2) + j\omega L_2 + \frac{\omega^2 M^2}{R_1 + R_S + j\omega L_1 - j/(\omega C_1)} \tag{11}$$

When $\omega=\omega_0$, $Z_2$ is purely resistive and $R_L$ should equal $Z_2$ for maximum efficiency $$Z_2 = R_2 + \frac{\omega^2 M^2}{R_1 + R_S} \equiv R_L. \tag{12}$$

The power delivered to the load is then:

$$P_L = \frac{1}{2}\frac{R_L \omega_0^2 M^2 |V_S|^2}{[(R_S + R_1)(R_2 + R_L) + \omega_0^2 M^2]^2}, \tag{13}$$

and the power efficiency is the power delivered to the load divided by the maximum possible power output, $$\eta \equiv \frac{P_L}{P_{MAX}} = \frac{4R_S R_L \omega_0^2 M^2}{[(R_S + R_1)(R_2 + R_L) + \omega_0^2 M^2]^2}. \tag{14}$$

The optimum values for $R_L$ and $R_L$ may be obtained by simultaneously solving $$R_S = R_1 + \frac{\omega^2 M^2}{R_2 + R_L} \text{ and } R_L = R_2 + \frac{\omega^2 M^2}{R_1 + R_S}, \tag{15}$$

with the result that:

$$R_S = R_1\sqrt{1+k^2 Q_1 Q_2} \text{ and } R_L = R_2\sqrt{1+k^2 Q_1 Q_2}. \tag{16}$$

Figure 3:
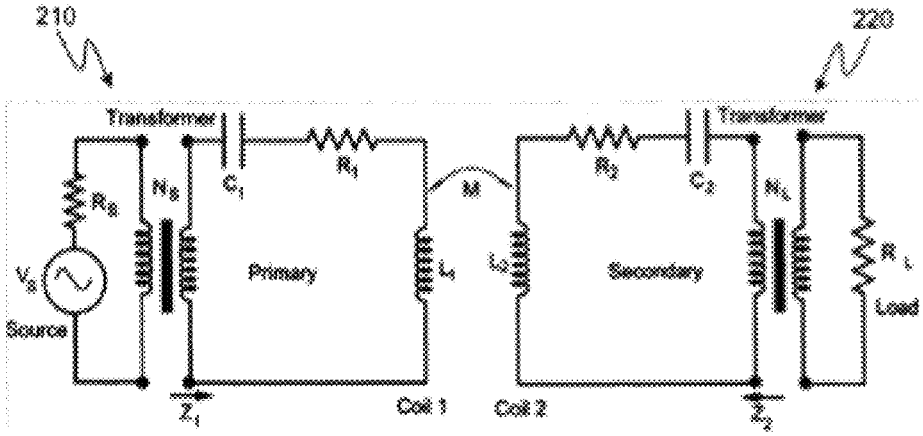
FIG. 3 is a schematic drawing depicting a primary or transmitting circuit and a secondary or receiving circuit with transformers having turn ratios $N_S$:1 and $N_L$:1 that may used to match impedances.
Figure 4:
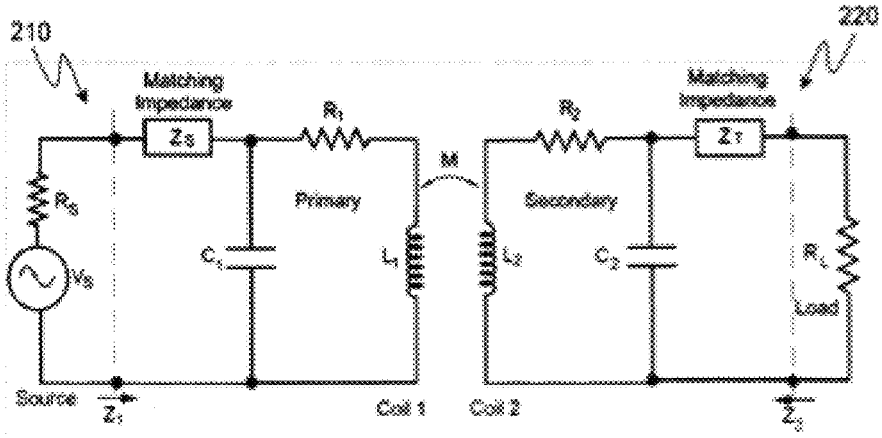
FIG. 4 is a schematic drawing depicting an alternative circuit to that which is depicted in FIG. 3 and having parallel capacitors that are used to resonate the coils' self-inductances.

If the source and load resistances do not satisfy equations (16), then it is envisioned that standard methods may be used to transform the impedances. For example, as shown in the FIG. 3 illustration, transformers with turn ratios $N_S$:1 and $N_L$:1 may be used to match impedances as per equations (16). Alternatively, the circuit illustrated in FIG. 4 may be used. In such an embodiment in FIG. 4, parallel capacitors are used to resonate the coils' self-inductances according to equation (2). As before, $Z_1$ is defined as the impedance seen by the source looking toward the load, while $Z_2$ is defined as the impedance seen by the load looking toward the source. In addition, there are two matching impedances, $Z_S$ and $Z_T$ which may be used to cancel any reactance that would otherwise be seen by the source or load. Hence $Z_1$ and $Z_2$ are purely resistive with the proper choices of $Z_S$ and $Z_T$. Notably, the source resistance $R_S$ may equal $Z_1$, and the load resistance $R_L$ may equal $Z_2$. The procedures for optimizing efficiency with series capacitance or with parallel capacitance may be the same, and both approaches may provide high efficiencies.

Figure 5B:
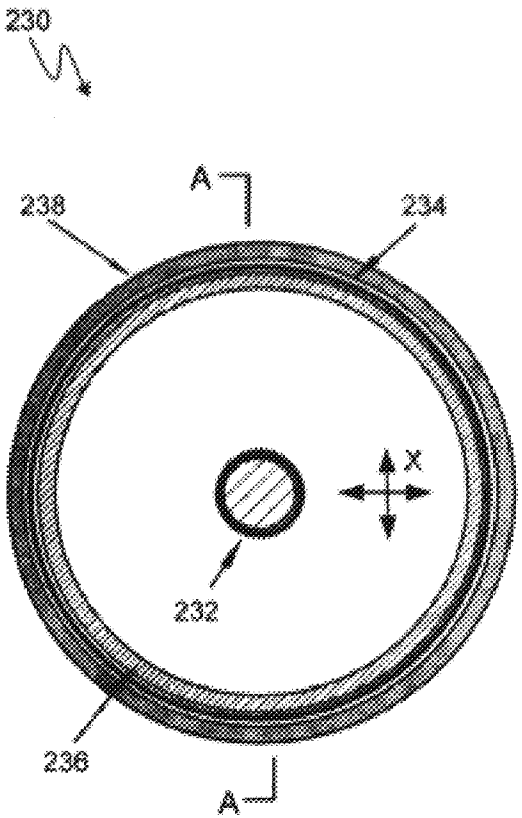
FIGS. 5A-5B illustrate an embodiment of a receiving coil inside a transmitting coil.
Figure 5A:
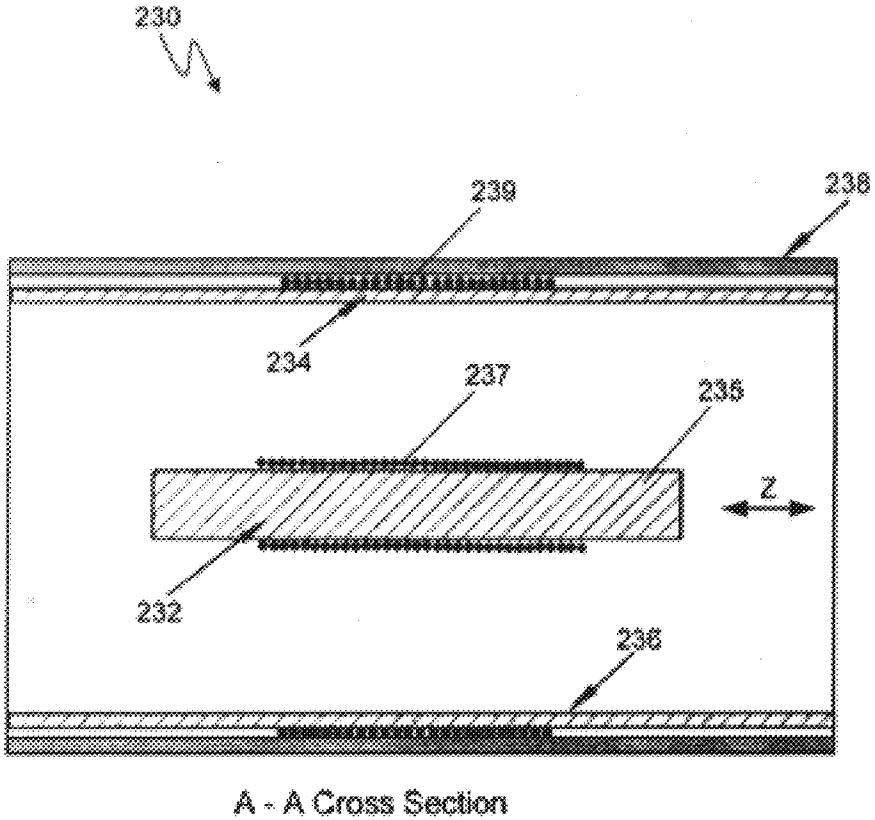

Turning now to FIGS. 5A and 5B, a cross sectional view of two coils 232, 234 is illustrated in FIG. 5A and a side view of the two coils 232, 234 is illustrated in FIG. 5B. In these two figures, a receiving coil 232 inside a transmitting coil 234 of a particular embodiment 230 is depicted. The receiving coil 232 includes a ferrite rod core 235 that, in some embodiments, may be about 12.5 mm (about 0.49 inch) in diameter and about 96 mm (about 3.78 inches) long with about thirty-two turns of wire 237. Notably, although specific dimensions and/or quantities of various components may be offered in this description, it will be understood by one of ordinary skill in the art that the embodiments are not limited to the specific dimensions and/or quantities described herein.

Returning to FIG. 5, the transmitting coil 234 may include an insulating housing 236, about twenty-five turns of wire 239, and an outer shell of ferrite 238. The wall thickness of the ferrite shell 238 in the FIG. 5 embodiment may be about 1.3 mm (about 0.05 inch). In certain embodiments, the overall size of the transmitting coil 234 may be about 90 mm (about 3.54 inch) in diameter by about 150 mm (about 5.90 inches) long. The receiving coil 232 may reside inside the transmitting coil 234, which is annular.

The receiving coil 232 may be free to move in the axial (z) direction or in the transverse direction (x) with respect to the transmitting coil 234. In addition, the receiving coil 232 may be able to rotate on axis with respect to the transmitting coil 234. The region between the two coils 232, 234 may be filled with air, fresh water, salt water, oil, natural gas, drilling fluid (known as "mud"), or any other liquid or gas. The transmitting coil 234 may also be mounted inside a metal tube, with minimal affect on the power efficiency because the magnetic flux may be captured by, and returned through, the ferrite shell 238 of the transmitting coil 234.

The operating frequency for these coils 232, 234 may vary according to the particular embodiment, but, for the FIG. 5 example 230, a resonant frequency f=100 kHz may be assumed. At this frequency, the transmitting coil 234 properties are: $L_1=6.76\cdot10^{-5}$ Henries and $R_1=0.053$ ohms, and the receiving coil 232 properties are $L_2=7.55\cdot10^{-5}$ Henries and $R_2=0.040$ ohms. The tuning capacitors are $C_1=3.75\cdot10^{-8}$ Farads and $C_2=3.36\cdot10^{-8}$ Farads. Notably, the coupling coefficient k value depends on the position of the receiving coil 232 inside the transmitting coil 234. The receiving coil 232 is centered when x=0 and z=0 and there is k=0.64.

Figure 6:
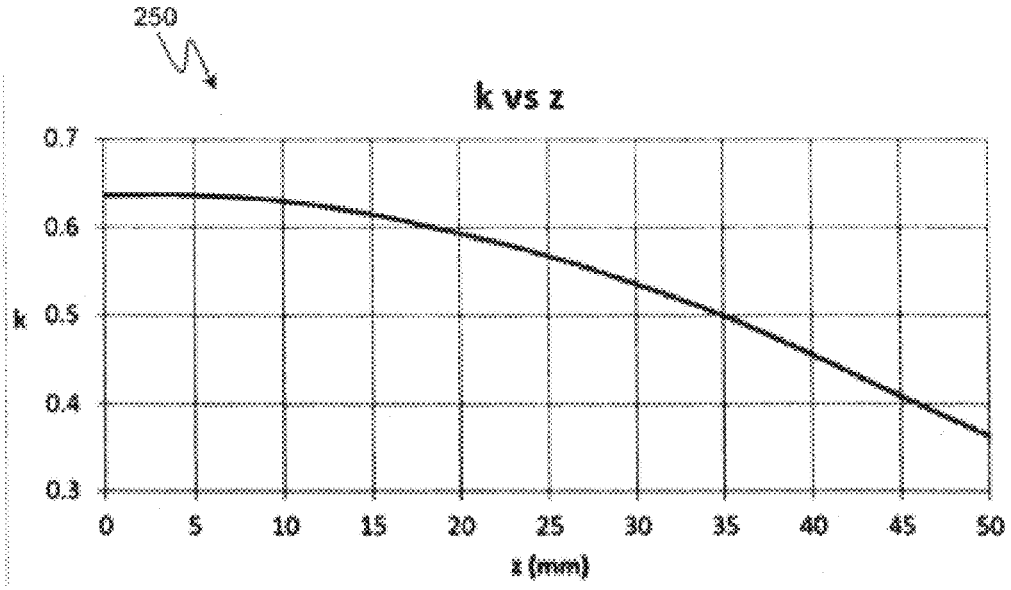
FIGS. 6-7 are graphs illustrating the variation in k versus axial displacement of the receiving coil when x=0 is small and the transverse displacement when z=0 produces very small changes in k of given embodiments, respectively.
Figure 7:
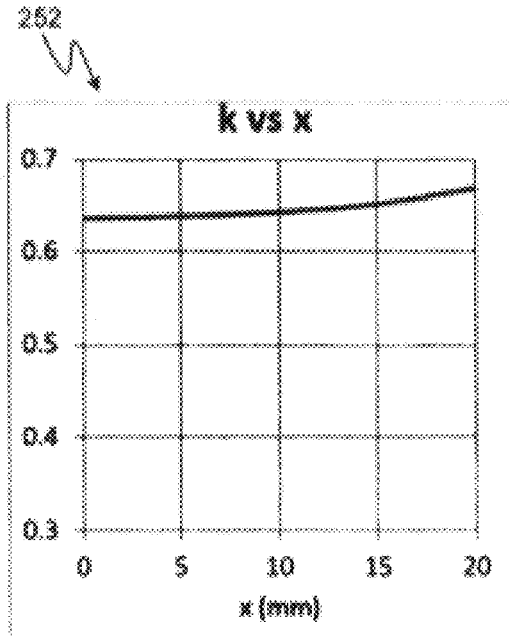
Figure 8:
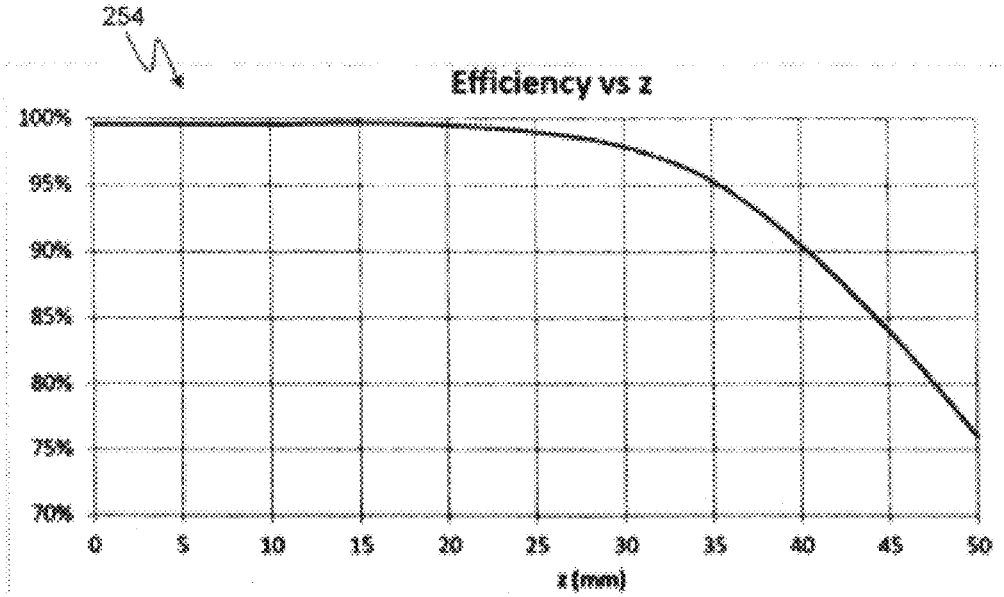
FIGS. 8-9 are graphs illustrating that power efficiency may also be calculated for displacements from the center in the z direction and in the x direction, respectively, of given embodiments.

The variation in k versus axial displacement of the receiving coil 232 when x=0 may be relatively small, as illustrated by the graph 250 in FIG. 6. The transverse displacement when z=0 may produce very small changes in k, as illustrated by the graph 252 in FIG. 7. The receiving coil 232 may rotate about the z-axis without affecting k because the coils are azimuthally symmetric. According to equations (16), an optimum value for the source resistance may be $R_S=32$ ohms, and for the load resistance may be $R_L$=24 ohms when the receiving coil 232 is centered at x=0 and z=0. The power efficiency may thus be η=99.5%.

Figure 9:
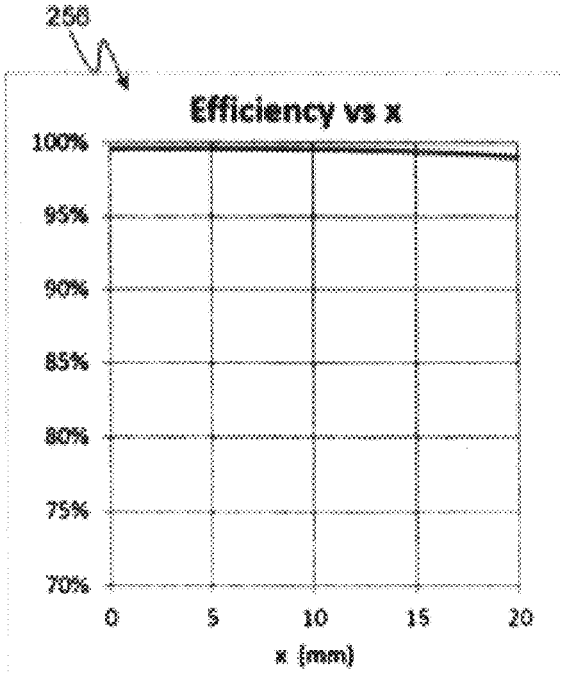

The power efficiency may also be calculated for displacements from the center in the z direction in mm (as illustrated by the graph 254 in FIG. 8) and in the x direction in mm (as illustrated by the graph 256 in FIG. 9). It is envisioned that the efficiency may be greater than about 99% for axial displacements up to about 20.0 mm (about 0.79 inch) in certain embodiments, and greater than about 95% for axial displacements up to about 35.0 mm (about 1.38 inches). It is further envisioned that the efficiency may be greater than 98% for transverse displacements up to 20.0 mm (about 0.79 inch) in some embodiments. Hence, the position of the receiving coil 232 inside the transmitting coil 234 may vary in some embodiments without reducing the ability of the two coils 232, 234 to efficiently transfer power.

Figure 10:
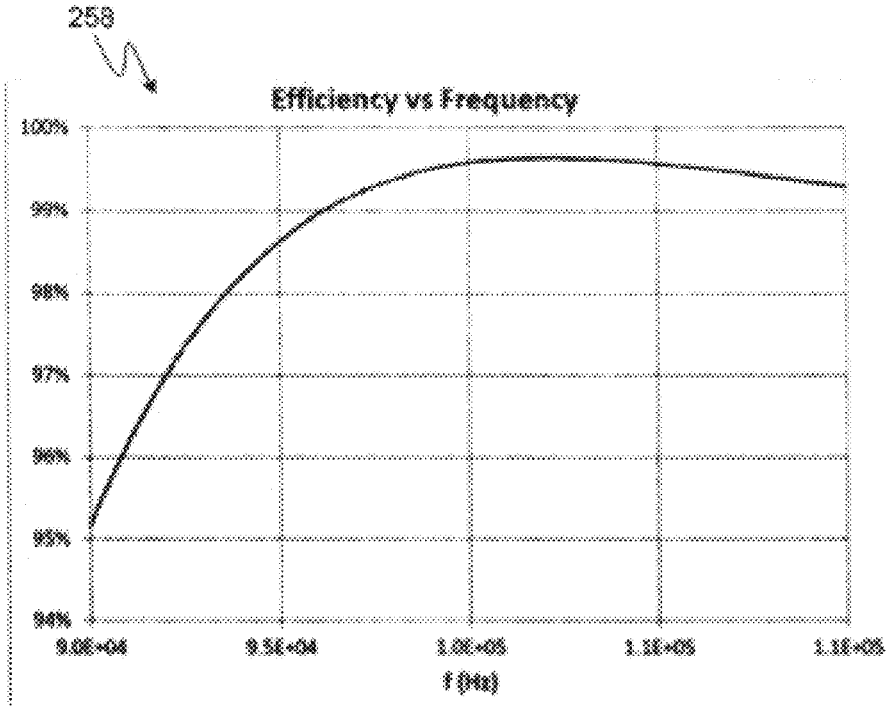
FIG. 10 is a graph illustrating that the sensitivity of the power efficiency to frequency drifts may be relatively small in some embodiments.
Figure 11:
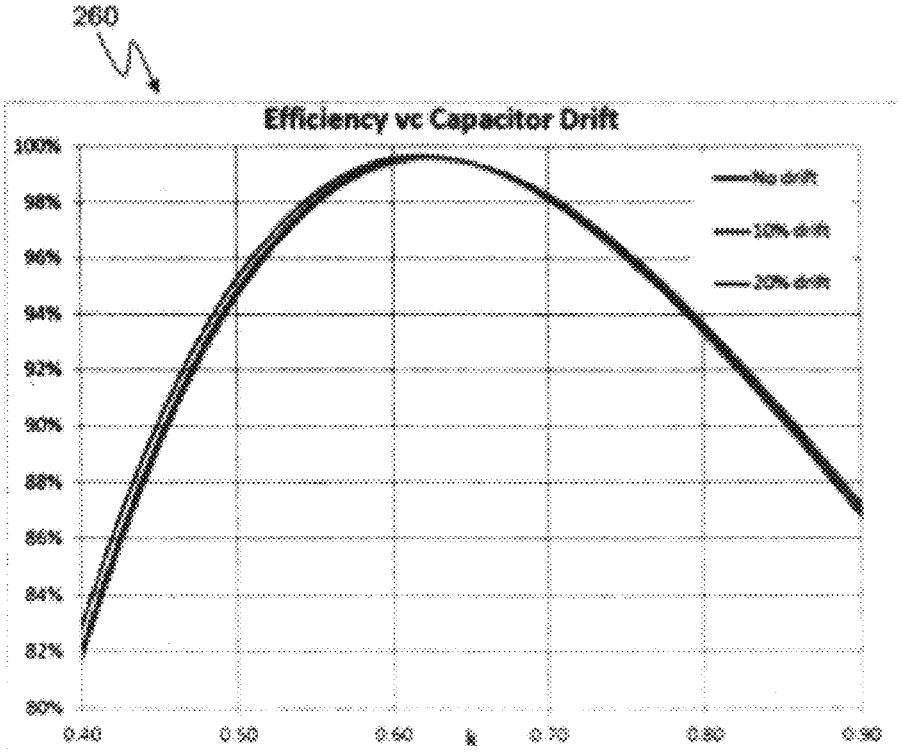
FIG. 11 is a graph illustrating that drifts in the components values of some embodiments do not have a large effect on the power efficiency of the embodiment.

Referring now to FIG. 10, it can be seen in the illustrative graph 258 where the Y-axis denotes efficiency in percentage and the X-axis denotes frequency in Hz that the sensitivity of the power efficiency to frequency drifts may be relatively small. A ±10% variation in frequency may produce minor effects, while the coil parameters may be held fixed. The power efficiency at 90,000 Hz is better than about 95%, and the power efficiency at 110,000 Hz is still greater than about 99%. Similarly, drifts in the component values may not have a large effect on the power efficiency. For example, both tuning capacitors $C_1$ and $C_2$ are allowed to increase by about 10% and by about 20% as illustrated in the graph 260 of FIG. 11. Notably, the other parameters are held fixed, except for the coupling coefficient k. The impact of the power efficiency is negligible. As such, the system described herein would be understood by one of ordinary skill in the art to be robust.

It is also envisioned that power may be transmitted from the inner coil to the outer coil of particular embodiments, interchanging the roles of transmitter and receiver. It is envisioned that the same power efficiency would be realized in both cases.

Figure 12:
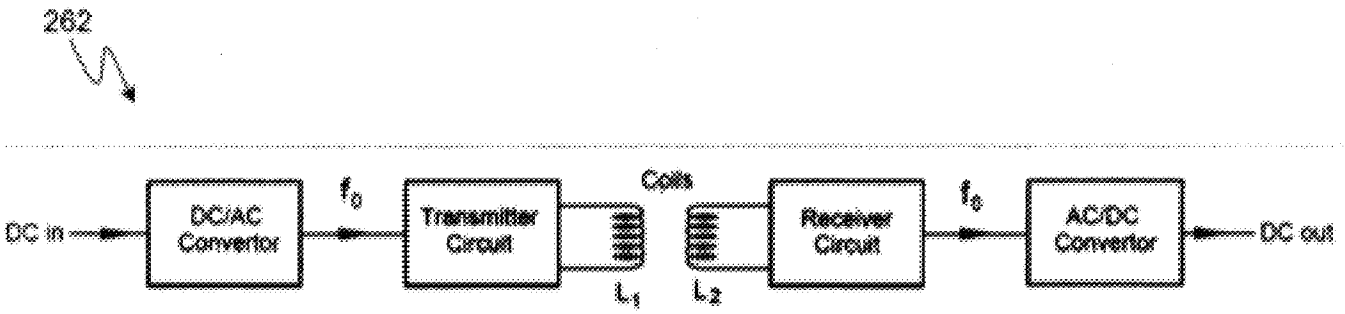
FIG. 12 depicts a particular embodiment configured to convert input DC power to a high frequency AC signal, $f_0$, via a DC/AC convertor.

Referring to FIG. 12, an electronic configuration 262 is illustrated for converting input DC power to a high frequency AC signal, $f_0$, via a DC/AC convertor. The transmitter circuit in the configuration 262 excites the transmitting coil at resonant frequency $f_0$. The receiving circuit drives an AC/DC convertor, which provides DC power output for subsequent electronics. This system 262 is appropriate for efficient passing DC power across the coils.

Figure 13:
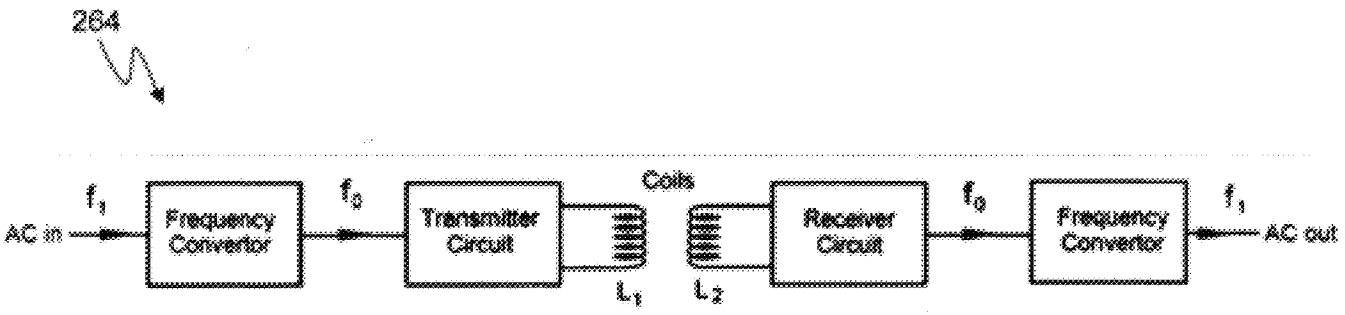
FIG. 13 depicts a particular embodiment configured to pass AC power through the coils.

Turning to FIG. 13, AC power can be passed through the coils. Input AC power at frequency $f_1$ is converted to resonant frequency $f_0$ by a frequency convertor. Normally this would be a step up convertor with $f_0 >> f_1$. The receiver circuit outputs power at frequency $f_0$, which is converted back to AC power at frequency $f_1$. Alternatively, as one of ordinary skill in the art recognizes, the FIG. 13 embodiment 264 could be modified to accept DC power in and produce AC power out, and vice versa.

In lieu of, or in addition to, passing power, data signals may be transferred from one coil to the other in certain embodiments by a variety of means. In the above example, power is transferred using an about 100.0 kHz oscillating magnetic field. It is envisioned that this oscillating signal may also be used as a carrier frequency with amplitude modulation, phase modulation, or frequency modulation used to transfer data from the transmitting coil to the receiving coil. Such would provide a one-way data transfer.

An alternative embodiment includes additional secondary coils to transmit and receive data in parallel with any power transmissions occurring between the other coils described above, as illustrated in FIG. 14. Such an arrangement may provide two-way data communication in some embodiments. The secondary data coils 266, 268 may be associated with relatively low power efficiencies of less than about 10%. It is envisioned that in some embodiments the data transfer may be accomplished with a good signal to noise ratio, for example, about 6.0 dB or better. The secondary data coils 266, 268 may have fewer turns than the power transmitting 234 and receiving coils 232.

Figure 14:
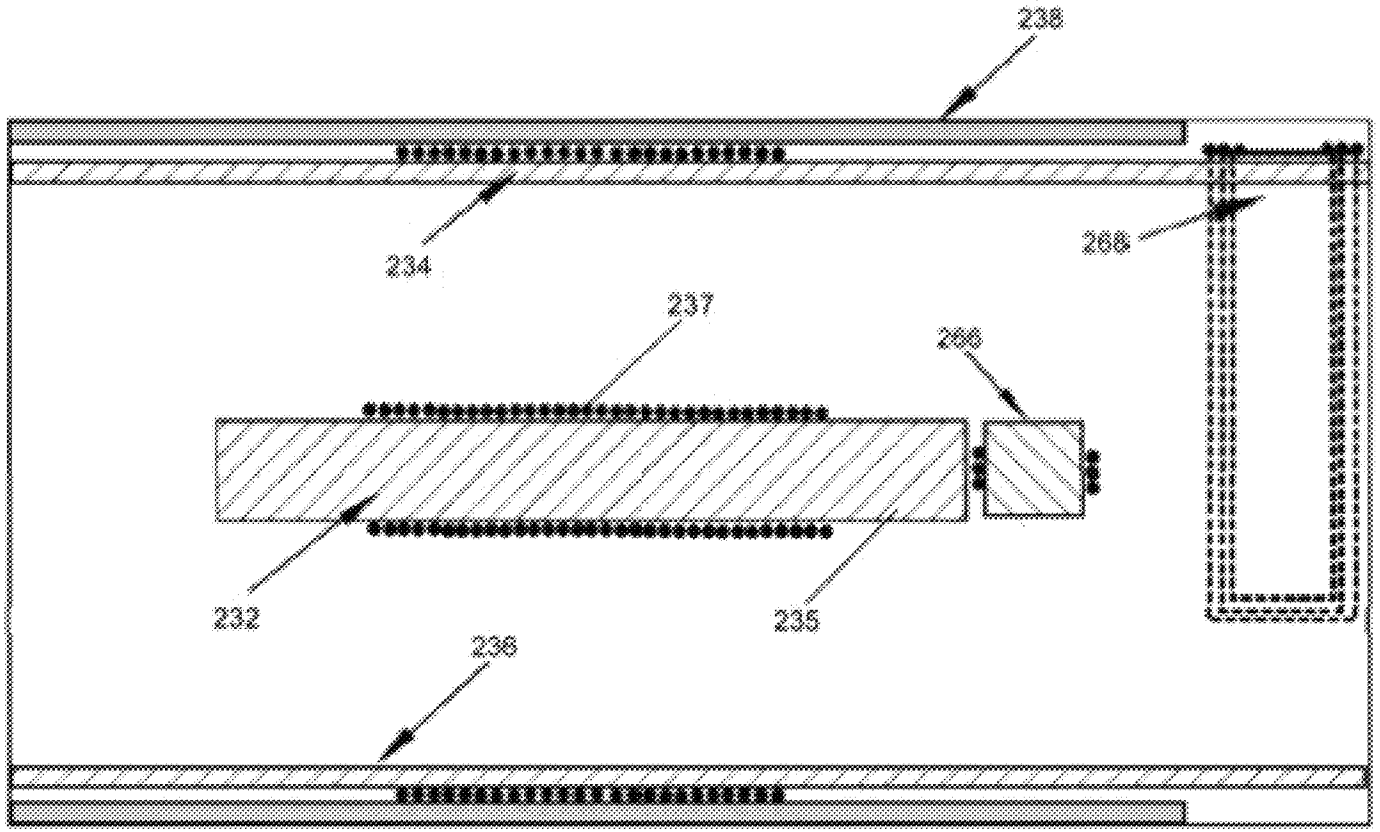
FIG. 14 depicts a particular embodiment that includes additional secondary coils configured to transmit and receive data.

The secondary data coils 266, 268 may be orthogonal to the power coils 232, 234, as illustrated in FIG. 14. For example, the magnetic flux from the power transmitting coils 232, 234 may be orthogonal to a first data coil 266, so that it does not induce a signal in the first data coil 266. A second data coil 268 may be wrapped as shown in FIG. 14 such that magnetic flux from the power transmitters does not pass through it, but magnetic flux from first data coil 266 does. Notably, the configuration depicted in FIG. 14 is offered for illustrative purposes only and is not meant to suggest that it is the only configuration that may reduce or eliminate the possibility that a signal will be induced in one or more of the data coils by the magnetic flux of the power transmitting coils. Other data coil configurations that may minimize the magnetic flux from the power transmitter exciting the data coils will occur to those with ordinary skill in the art.

Moreover, it is envisioned that the data coils 266, 268 may be wound on a non-magnetic dielectric material in some embodiments. Using a magnetic core for the data coils 266, 268 might result in the data coils' cores being saturated by the strong magnetic fields used for power transmission. Also, the data coils 266, 268 may be configured to operate at a substantially different frequency than the power transmission frequency. For example, if the power is transmitted at about 100.0 kHz in a certain embodiment, then the data may be transmitted at a frequency of about 1.0 MHz or higher. In such an embodiment, high pass filters on the data coils 266, 268 may prevent the about 100.0 kHz signal from corrupting the data signal. In still other embodiments, the data coils 266, 268 may simply be located away from the power coils 232, 234 to minimize any interference from the power transmission. It is further envisioned that some embodiments may use any combination of these methods to mitigate or eliminate adverse effects on the data coils 266, 268 from the power transmission of the power coils 232, 234.

Having described the structure and operation of various embodiments of the wireless power and data connection 204 with reference to FIGS. 2-14, various embodiments of configurations of a BHA 100 incorporating a wireless power and data connection will be described. The BHA configurations illustrate different embodiments for arranging various components within the BHA 100. These and other BHA configurations may provide wireless power and data transfer to components above and/or below a downhole drilling motor 206 and, thereby, advantageously enable real-time measurement and control of various drilling conditions for optimizing drilling performance and/or reducing drilling costs.

Figure 15:
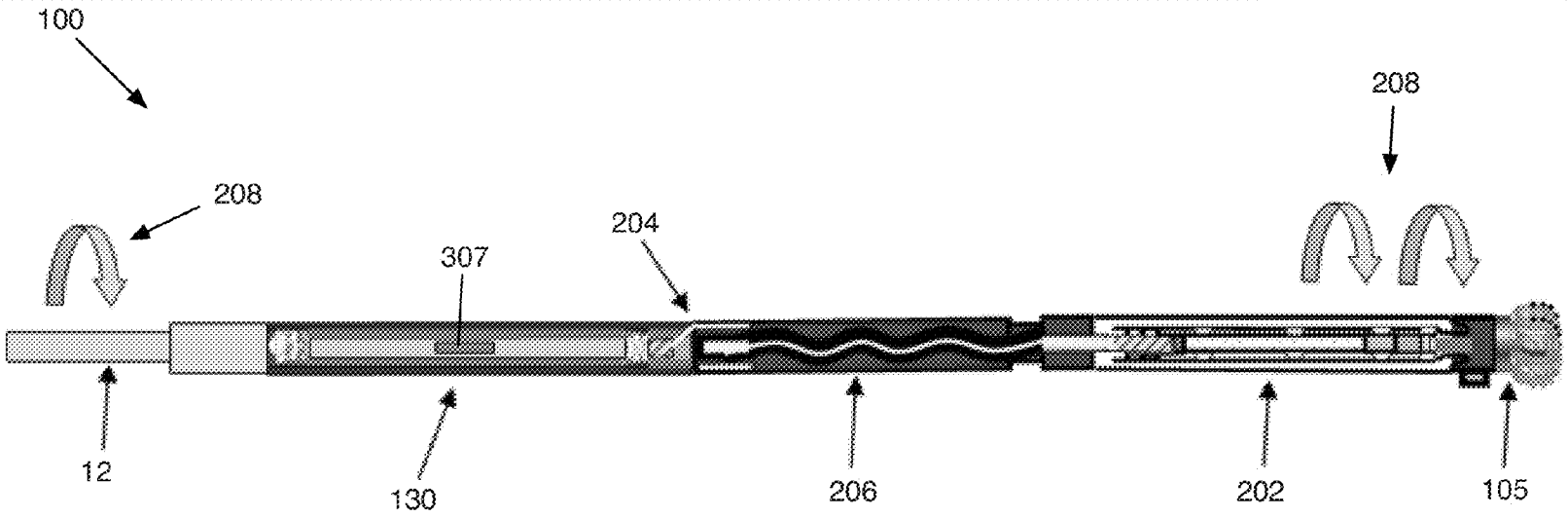
FIG. 15 is a diagram of an embodiment of a bottom hole assembly configuration for enabling wireless power and data transfer between components in the bottom hole assembly.

In the embodiment of FIG. 15, the BHA 100 includes a MWD module 130 connected to drill string 12. The MWD module 130 includes a system including, for example, power component(s), telemetry component(s), and a directional & inclination (D&I) survey package 307. A wireless power and data connection 204 may be attached to the downhole end of the MWD module 130. This wireless power and data connection 204 is described above in connection with FIGS. 2-14.

The wireless power and/or data connection 204 may be used to replace the physical single pin connection typically found in conventional drilling and measurement (D&M)

tools. As described above with reference to FIGS. 2-14, the wireless power and/or data connection 204 includes a wireless, tuned-inductive coupler mechanism for passing both power and data communications to downhole components of the BHA 100. It should be appreciated that separate coils may be used for power and communication transmissions as described above and illustrated in FIG. 14.

Below the drill string 12, the MWD module 130 is connected to the drilling motor 206, which is in turn connected to the RSS 202. RSS 202 and motor 206 are one embodiment of the rotary-steerable system and motor 150 illustrated in FIG. 1B. A drill bit 105 is attached to the downhole end of the RSS 202. Power and/or data pass through the wireless connection 204 between the MWD module 130 and the drilling motor 206.

It should be appreciated that the placement of the MWD module 130 and the D&I survey package above the drilling motor 206 provides certain desirable features, including allowing surveys to be taken while pumping. This configuration may avoid the need for a battery in the MWD module 130 for performing stationary surveys with the drilling pumps disabled.

If the MWD module 130 is located below the drilling motor 206, the pumps must be disabled to stop rotation of the D&I survey package. Furthermore, turbine power is not available when pumps are off, so a battery must be used to power the D&I survey package along with logic using other parts of the system to detect when pumps are off. In the BHA configuration illustrated in FIG. 2, the placement of the mud pulse telemetry in the MWD module 130 above the drilling motor 206 also avoids attenuation of data signals due to the pulses passing through the drilling motor 206, which can be particularly problematic at higher data rates.

Referring again to FIG. 15, the wireless power and/or data connection 204 allows relative rotational motion (reference numeral 208) between the MWD module 130 (which is coupled to the external housing of the drilling motor 206) and the rotor of the drilling motor 206 (which is connected to the RSS 202 and the drill bit 105), allowing power and data transfer throughout the entire BHA 100. The RSS 202 may rotate at a higher RPM than the drill string 12 because it is below the drilling motor 206.

Figure 16:
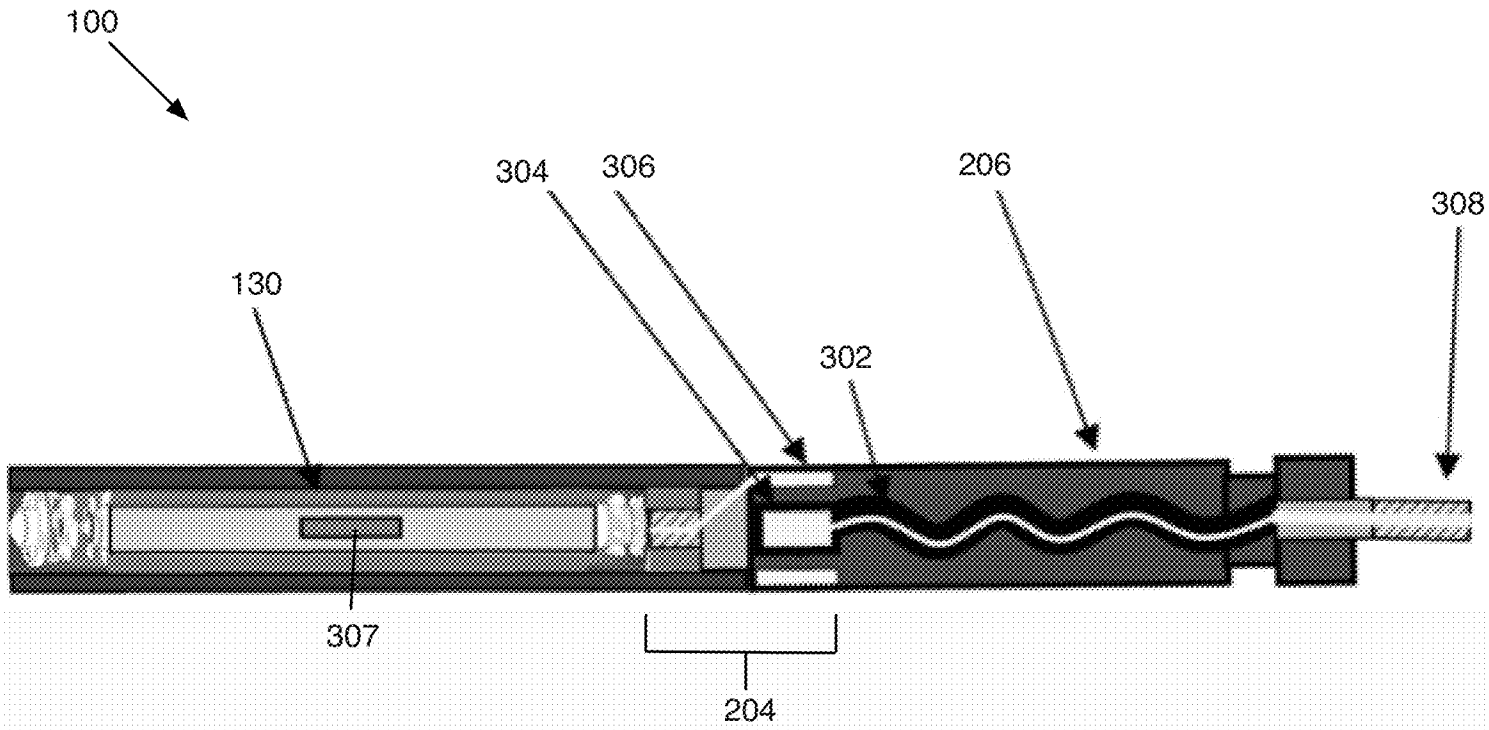
FIG. 16 is a diagram illustrating the MWD module and the wireless power and data connection of the bottom hole assembly of FIG. 15.

FIG. 16 illustrates in more detail the wireless power and data connection 204 disposed between the MWD module 130 and the drilling motor 206. Power and data connections exit the downhole end of a modulator and turbine power system and are coupled to a stationary coil 306 of the wireless power and data connection 204, which may be located in the external housing of the drilling motor 206. Power and/or data are transmitted between the stationary coil 306 and a rotating coil 304 via tuned-inductive methods described in detail above in connection with FIGS. 5A-5B. Wiring is coupled to the rotating coil 304 and passes through an interior sealed channel in the center of the rotor 302 of the drilling motor 206.

At the downhole or bottom end of the rotor, the wire terminates at a connection 308 to the RSS 202. In an embodiment, the connection 308 may include a threaded rotary shouldered joint and a sealed electrical connector that mechanically and electrically couples the rotating mechanism of the drilling motor 206 to the RSS 202.

Figure 17:
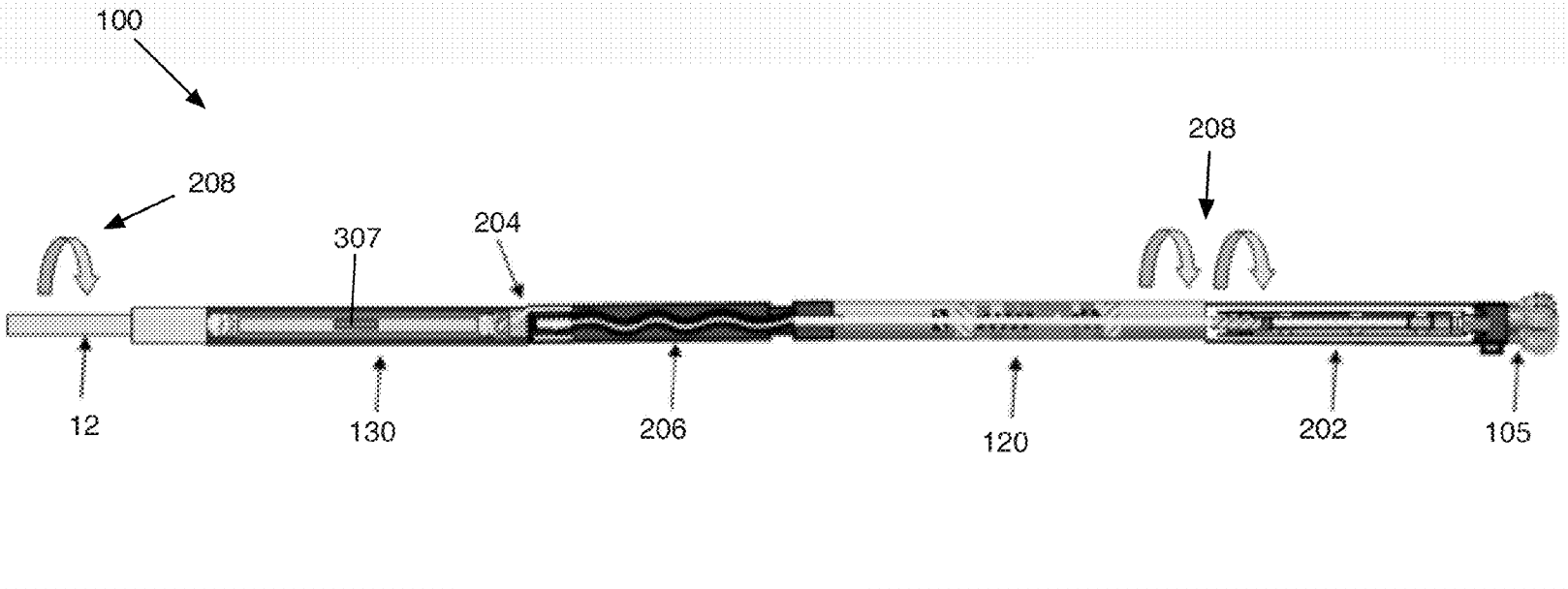
FIG. 17 is a diagram illustrating another embodiment of a bottom hole assembly configuration that includes a LWD module for enabling wireless power and data transfer between components in the bottom hole assembly.

Various additional BHA embodiments and configurations are illustrated in FIGS. 17-20. In the embodiment of FIG. 17, the LWD module 120 is located below the drilling motor 206 in the BHA 100. The LWD module 120 is disposed between the drilling motor 206 and the RSS 202. The LWD module 120 is connected to the drilling motor 206 via the wired rotor.

Figure 18:
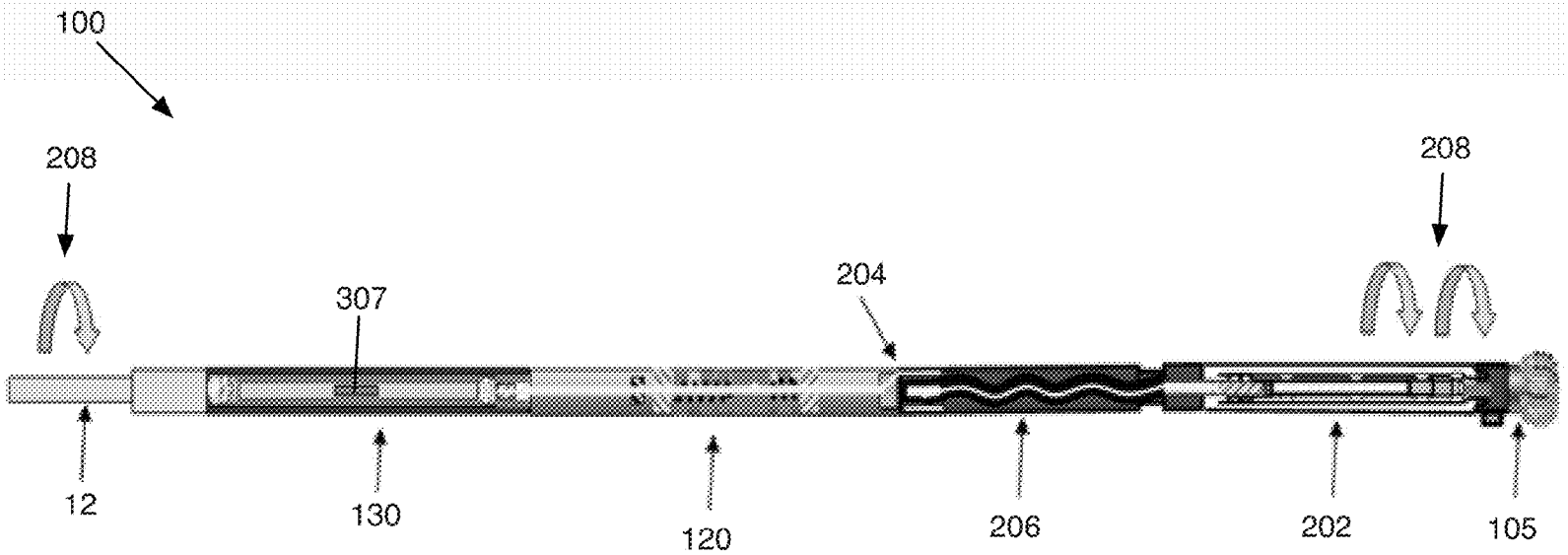
FIG. 18 is a diagram illustrating a further embodiment of a bottom hole assembly configuration that includes a LWD module.
Figure 19:
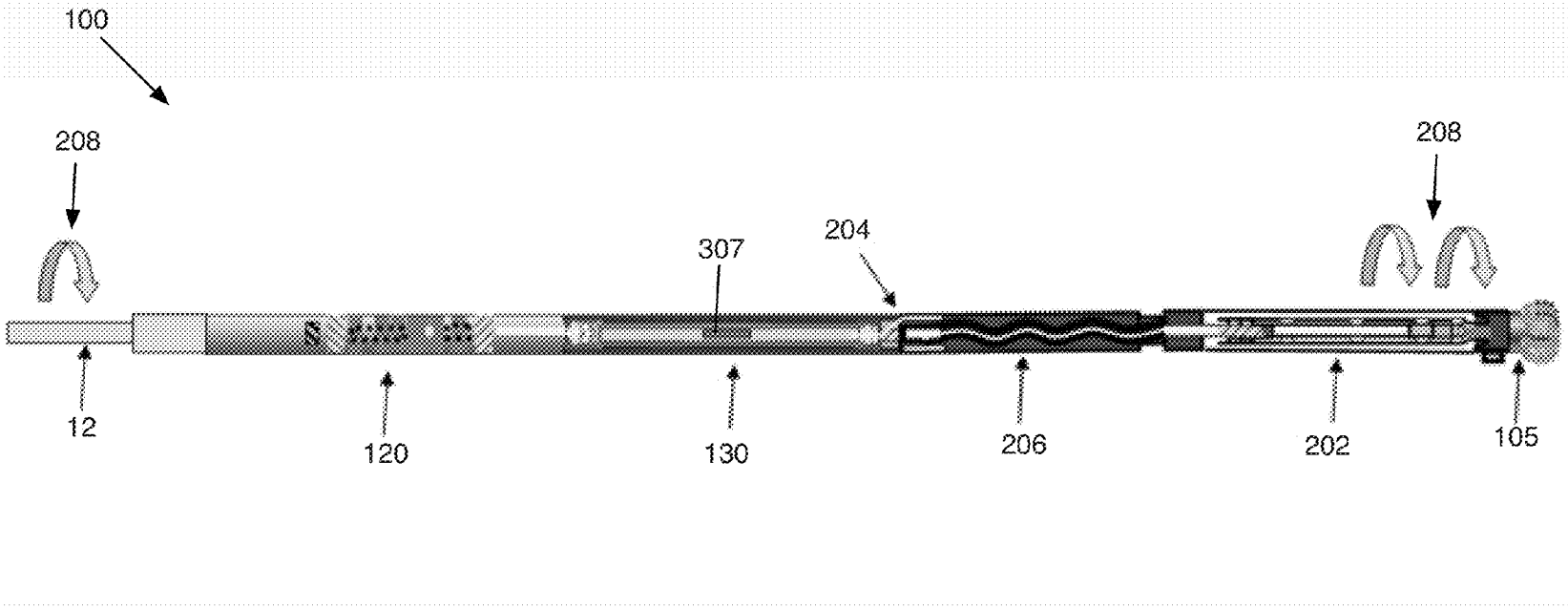
FIG. 19 is a diagram illustrating a further embodiment of a bottom hole assembly configuration that includes a LWD module.
Figure 20:
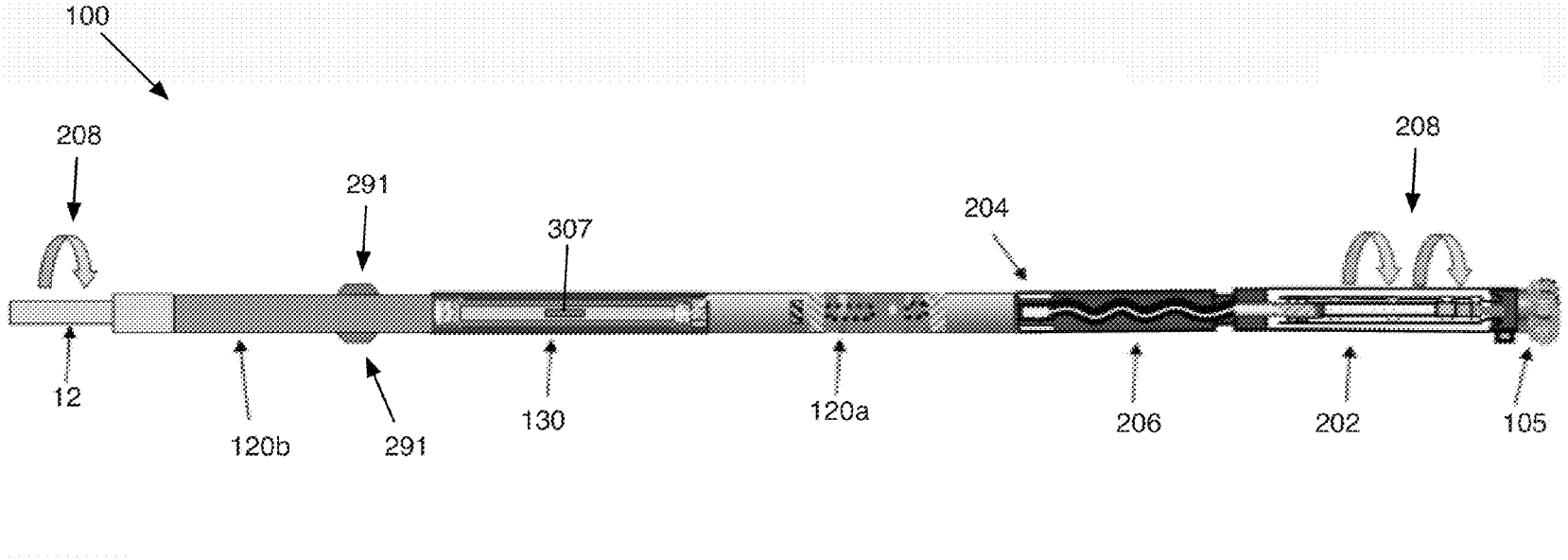
FIG. 20 is a diagram illustrating a further embodiment of a bottom hole assembly configuration that includes a LWD module.

In the embodiments of FIGS. 18-20, the LWD module 120 is disposed above rather than below the drilling motor 206. In this BHA configuration, the LWD module is adjacent the MWD module 130 and, therefore, will not be rotated by the drilling motor 206. It should be appreciated that this BHA configuration may provide certain advantages with respect to operational conditions, such as, for example, shock, vibrations, stick/slip, measurement proximity to the drill bit 105, measurement physics, etc.

One of ordinary skill in the art will appreciate that these BHA configurations are not the only possible configurations, but merely presented to illustrate the flexibility of component placement when using a drilling motor 206 with wireless power and data capability. In FIG. 18, the LWD module 120 is disposed between the MWD module 130 and the drilling motor 206. In the configuration illustrated in FIG. 19, the location of the LWD module 120 and the MWD module 130 are reversed, such that the MWD module 130 is located closer to the drilling motor 206. The LWD module 120 is disposed above, and connects to, the MWD module 130.

The embodiment illustrated in FIG. 20 includes two LWD modules: a primary LWD module 120*a* and a secondary LWD module 120*b*. The primary LWD module 102*a* may be disposed between the drilling motor 206 and the MWD module 130, and the secondary LWD module 102*b* may be disposed above the MWD module 130. The multi-LWD configuration may advantageously provide for a plurality of different types and combinations of measurements.

In an embodiment, the primary LWD module 102*a* may enable measurements, such as, for example, the resistivity of the surrounding formation and/or fluids. The secondary LWD module 102*b* may be configured for borehole diameter, density, and neutron porosity measurements. In this regard, the LWD module 102*b* may include one or more pads 291 disposed on the outer housing. The pads 291 may include mounted sensors for taking appropriate measurements.

It should be further appreciated that additional BHA configurations may enable measurements at the drilling bit 105 when using the drilling motor 206. In operation, the drill bit 105 is driven by the drilling motor 206 to form the borehole while simultaneously permitting measurements and communications with the LWD module 120, the MWD module 130, or other components of the system 102 (FIG. 1).

The drill bit 105 may be rotated by the drilling motor 206 or by another suitable driving device. The drill bit 105 and other BHA components may have a variety of sensors and signal transmission systems to provide an operator with real-time data and/or other data useful in both drilling the borehole and/or steering the BHA 100 along a variety of desired trajectories through a reservoir.

Figure 21:
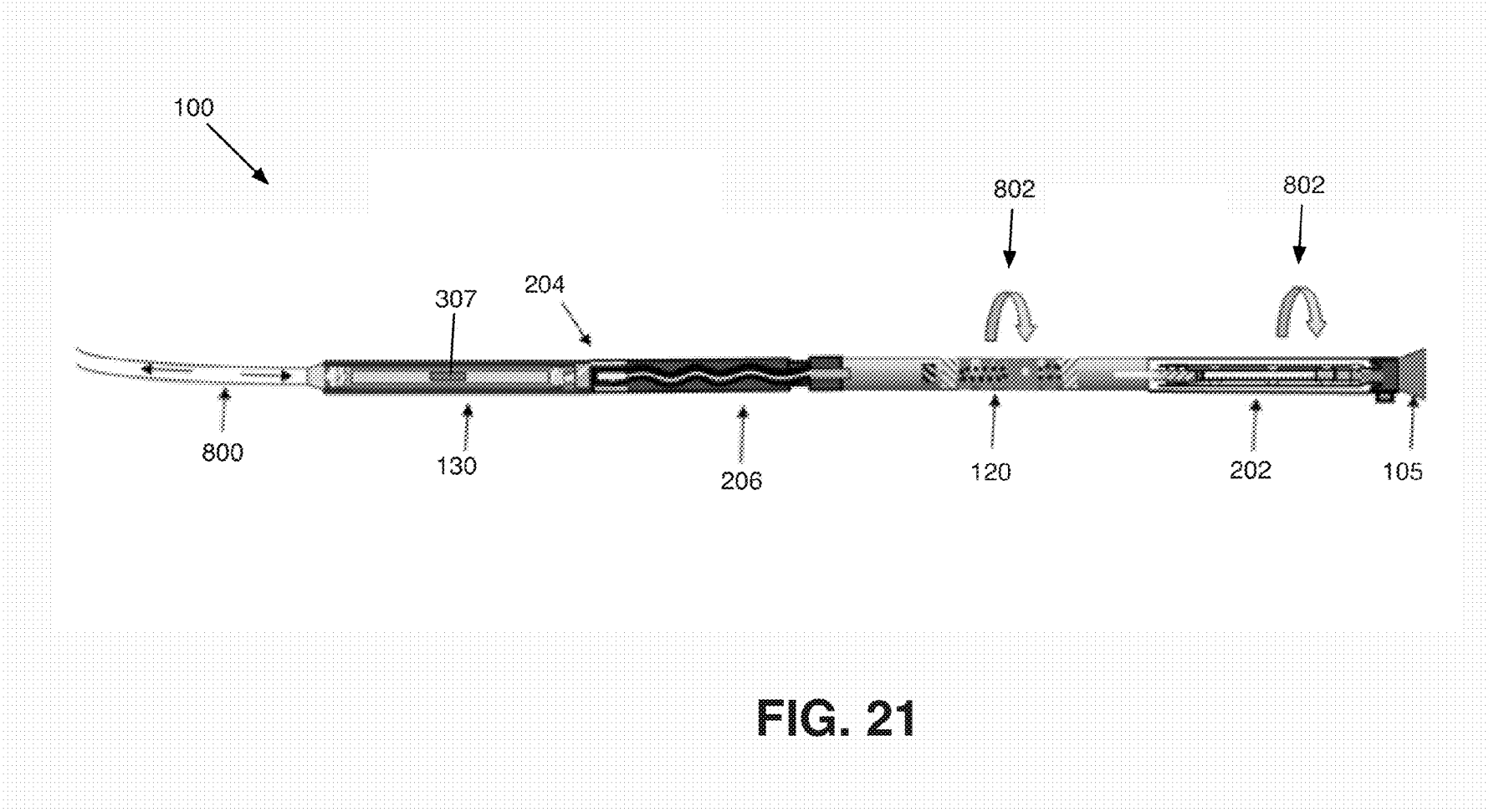
FIG. 21 is a diagram illustrating another embodiment of a bottom hole assembly configuration for enabling wireless power and data transfer to a LWD module and rotary steerable system.
Figure 22:
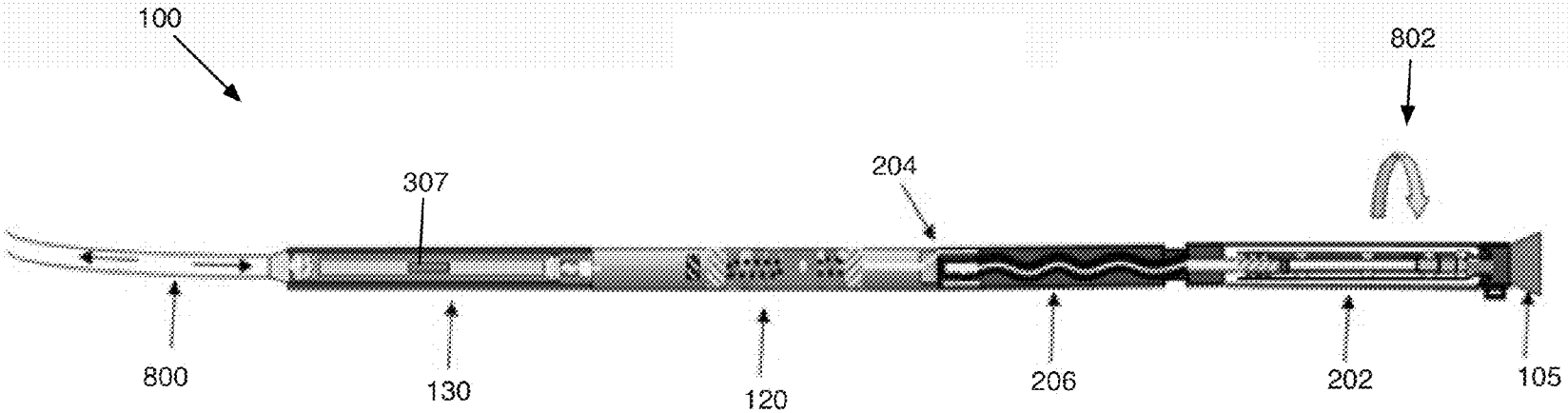
FIG. 22 is a diagram illustrating another embodiment of a bottom hole assembly configuration with an alternative position for LWD module.
Figure 23:
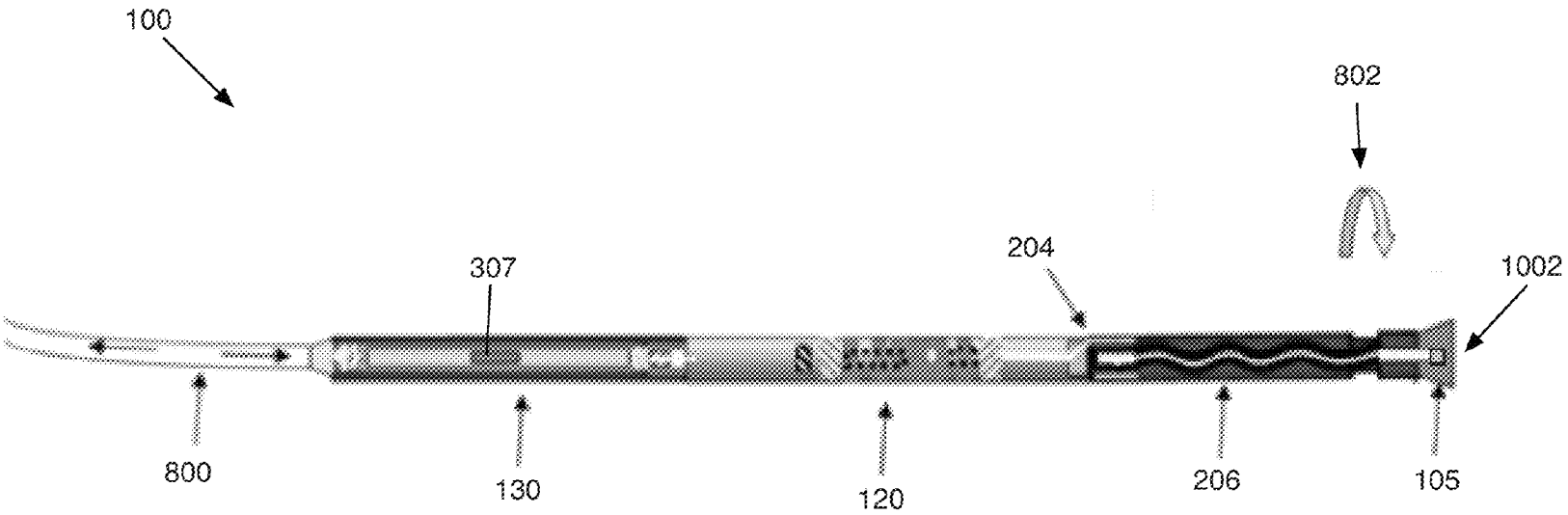
FIG. 23 is a diagram illustrating another embodiment of a bottom hole assembly configuration that includes an embedded sensor in the drill bit for providing real-time measurements to the MWD module.

A drilling motor 206 with a wireless power and data connection 204 enables the BHA 100 to pass power and data communication from an uphole component to a downhole component and vice versa. FIGS. 21-23 illustrate additional BHA configurations that provide further flexibility in the placement of the MWD module 130 and the LWD 120, and which enable measurements at the drill bit 105 when using the drilling motor 206. These embodiments may be implemented in various drilling contexts, including coupling to a coiled tube 800, and may incorporate full rotation of the rotor of the drilling motor 206 and enable the power generation to be positioned on the uphole side of the drilling motor 206 while sensors and/or the LWD tools may be placed on the downhole side of the drilling motor 206.

FIG. 21 illustrates a D&M BHA 100 that includes a drilling motor 206 with a wireless power and data connection 204, a MWD module 130, a LWD module 120, and a RSS 202. The MWD module 130 is connected to the drilling motor 206, which is in turn connected to an assembly having LWD module 120, RSS 202, and drill bit 105. Power and/or data pass through the wireless connection 204 between the modulator/turbine power system and the drilling motor 206. The wireless connection 204 allows relative motion (reference numeral 802) between the MWD module 130 (which is coupled to the external housing of the drilling motor 206) and the rotor of the drilling motor 206 (which is wired and coupled to the RSS/LWD/drill bit assembly), allowing power and data transfer throughout the entire BHA.

In this regard, the MWD module 130 may remain stationary, which may be advantageous for certain types of measurements. The LWD module 120, however, may be located below the drilling motor 206 (i.e., the rotating side), which may be advantageous to, for example, capture images by scanning around the borehole while the LWD module 120 rotates.

If added rotation of the LWD module 120 from the drilling motor 206 is not desired, an alternative arrangement of the BHA components may be employed, as illustrated in FIG. 22. In this embodiment, the LWD module 120 may be located to the non-rotating side of the drilling motor 206 and connected to a downhole end of the MWD module 130.

A further embodiment, as illustrated in FIG. 23, may include a direct connection of the drill bit 105 to the drilling motor 206. In this BHA configuration, the drill bit 105 may include a sensor 1002 for providing real-time measurements to the MWD module 130 that may be transmitted across the wireless connection 204 as described in detail above.

Although only a few embodiments have been described in detail above, those skilled in the art will readily appreciate that many modifications are possible in the embodiments without materially departing from this invention. Accordingly, all such modifications are intended to be included within the scope of this disclosure as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, sixth paragraph for any limitations of any of the claims herein, except for those in which the claim expressly uses the words 'means for' together with an associated function.

What is claimed is:

1. A method for providing wireless power and data communications in a bottom hole assembly for use in a drill string, the method comprising:

coupling a measuring-while-drilling (MWD) module to a drill string;

locating a wireless power and data connection above a drilling motor in the drilling string, the wireless power and data connection for providing power and data between the MWD module and the drilling motor; and coupling a rotary steerable system (RSS) to the drilling motor for receiving power from and communicating with the MWD module via the wireless power and data connection;

electrically coupling first and second coils in the wireless power and data connection with a coupling coefficient, k, wherein, $k=M/\sqrt{L_1L_2}\leq 0.9$, M is a mutual inductance between the first and second coils, $L_1$ is a first self-inductance of the first coil, and $L_2$ is a second self-inductance of the second coil; and resonantly tuning the first coil at a first frequency, $f_1$, with a first capacitance, $C_1$, and the second coil at a second frequency, $f_2$, with a second capacitance, $C_2$, wherein $f_1$ is approximately equal to $f_2$, $$f_1 = \frac{1}{2\pi\sqrt{L_1C_1}} \text{ and } f_2 = \frac{1}{2\pi\sqrt{L_2C_2}};$$

wherein the first and second coils have a figure of merit, U, wherein $U=k\sqrt{Q_1Q_2}\geq 3$, $$Q_1 = \frac{2\pi f_1 L_1}{R_1},\ Q_2 = \frac{2\pi f_2 L_2}{R_2},$$

$Q_1$ and $Q_2$ comprise respective quality factors associated with the first and second coils, and $R_1$ and $R_2$ comprise respective resistances of the first and second coils.

2. The method of claim 1, wherein the MWD module comprises a power generation component and a direction and inclination (D&I) survey package.

3. The method of claim 1, wherein the wireless power and data connection comprises a first coil located within a second coil.

4. The method of claim 3, wherein the first and second coils comprise cylindrical wire coils.

5. The method of claim 3, wherein the first coil comprises an inner coil comprising a wire wrapped on a core of material having a relatively high magnetic permeability.

6. The method of claim 3, further comprising:

approximately matching a source impedance of the first coil, $R_s$, with a load impedance of the second coil, $R_1$, wherein $R_S\approx R_1\sqrt{1+k^2Q_1Q_2}$.

7. The method of claim 3, further comprising:

approximately matching a load impedance of the second coil, $R_1$, with a source impedance of the first coil, $R_S$, wherein $R_L\approx R_2\sqrt{1+k^2Q_1Q_2}$.

8. The method of claim 3, further comprising:

transmitting power between the first and second coils.

9. The method of claim 3, further comprising:

transmitting data between the first and second coils.

10. The method of claim 9, wherein the transmitting data between the first and second coils comprises modulating one of an amplitude, a phase, and a frequency of a current.

11. A bottom hole assembly (BHA) configured for use in a drill string of a wellsite drilling system, the BHA comprising:

a measuring-while-drilling (MWD) module configured for coupling to a drill string, the MWD module comprising a power generation component and a direction and inclination (D&I) survey package;

a wireless power and data connection disposed above a drilling motor in the drilling string, and for providing power and data connectivity between the MWD module and the drilling motor; and a rotary steerable system (RSS) coupled to the drilling motor for receiving power from and communicating with the MWD module via the wireless power and data connection and the drilling motor;

wherein the wireless power and data connection comprises a pair of inductively coupled coils wherein:

the pair of coils comprise a first coil located within a second coil and the first and second coils are coupled with a coupling coefficient, k, wherein, $k=M/\sqrt{L_1L_2}\leq 0.9$, M is a mutual inductance between the first and second coils, $L_1$ is a first self-inductance of the first coil, and $L_2$ is a second self-inductance of the second coil;

the first coil is resonantly tuned at a first frequency, $f_1$, with a first capacitance, $C_1$, and the second coil at a second frequency, $f_2$, and the second coil is resonantly tuned with a second capacitance, $C_2$, wherein $f_1$ is approximately equal to $f_2$, $$f_1 = \frac{1}{2\pi\sqrt{L_1C_1}} \text{ and } f_2 = \frac{1}{2\pi\sqrt{L_2C_2}};$$

and the first and second coils have a figure of merit, U, wherein $U=k\sqrt{Q_1Q_2}\geq 3$, $$Q_1 = \frac{2\pi f_1 L_1}{R_1},\ Q_2 = \frac{2\pi f_2 L_2}{R_2},$$

$Q_1$ and $Q_2$ comprise respective quality factors associated with the first and second coils, and $R_1$ and $R_2$ comprise respective resistances of the first and second coils.

12. The BHA of claim 11, wherein the first coil comprises an inner coil comprising a wire wrapped on a core of material having a relatively high magnetic permeability.

* * * * *